US010269328B2

(12) United States Patent
Li

(10) Patent No.: US 10,269,328 B2
(45) Date of Patent: Apr. 23, 2019

(54) DISPLAY PANEL INCLUDING REFLECTIVE PIXELS AND SELF-DISPLAY PIXELS AND DRIVING METHOD THEREOF, DISPLAY APPARATUS

(71) Applicant: BOE TECHNOLOGY GROUP CO., LTD., Beijing (CN)

(72) Inventor: Wenbo Li, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 14 days.

(21) Appl. No.: 15/324,061

(22) PCT Filed: Mar. 24, 2016

(86) PCT No.: PCT/CN2016/077191

§ 371 (c)(1),
(2) Date: Jan. 5, 2017

(87) PCT Pub. No.: WO2017/041477

PCT Pub. Date: Mar. 16, 2017

(65) Prior Publication Data

US 2017/0206857 A1 Jul. 20, 2017

(30) Foreign Application Priority Data

Sep. 7, 2015 (CN) ..... 2015 1 0562982

(51) Int. Cl.
*G09G 5/10* (2006.01)
*G09G 3/38* (2006.01)
(Continued)

(52) U.S. Cl.
CPC ..... *G09G 5/10* (2013.01); *G09G 3/20* (2013.01); *G09G 3/2092* (2013.01); *G09G 3/38* (2013.01);
(Continued)

(58) Field of Classification Search
CPC ... G09G 2300/0404; G09G 2300/0426; G09G 2300/0456
See application file for complete search history.

(56) References Cited

U.S. PATENT DOCUMENTS 9,436,043 B2 9/2016 Huo et al.
2005/0243044 A1* 11/2005 Kang ..... G02F 1/136286 345/87
(Continued)

FOREIGN PATENT DOCUMENTS

CN 1474216 A 2/2004
CN 1892349 A 1/2007
(Continued)

OTHER PUBLICATIONS

First Office Action dated Jan. 26, 2017 in corresponding Chinese Application No. 201510562982.8.
(Continued)

*Primary Examiner* — Chun-Nan Lin
(74) *Attorney, Agent, or Firm* — Nath, Goldberg & Meyer; Joshua B. Goldberg

(57) ABSTRACT

The present invention provides a display panel, a driving method thereof, and a display apparatus, belongs to the field of display technology, and can solve the problem of mutual interference between two display modes in the existing transflective display apparatus. The display panel of the present invention includes: a plurality of reflective pixels, which perform image display using reflected light; and a plurality of self-display pixels, which perform image display using transmitted light or self-emitted light.

14 Claims, 3 Drawing Sheets

(51) Int. Cl.

| | |
|---|---|
| ***G09G 3/20*** | (2006.01) |
| *G09G 3/3208* | (2016.01) |
| *G09G 3/34* | (2006.01) |
| *G09G 3/36* | (2006.01) |

(52) U.S. Cl.
CPC ..... *G09G 3/3208* (2013.01); *G09G 3/3453* (2013.01); *G09G 3/3607* (2013.01); *G09G 2300/0404* (2013.01); *G09G 2300/0426* (2013.01); *G09G 2300/0456* (2013.01); *G09G 2300/08* (2013.01); *G09G 2310/02* (2013.01); *G09G 2310/0267* (2013.01); *G09G 2360/144* (2013.01)

(56) References Cited

U.S. PATENT DOCUMENTS

| | | | | |
|---|---|---|---|---|
| 2007/0291208 | A1 | 12/2007 | Wang et al. | |
| 2008/0055519 | A1* | 3/2008 | Battersby | G09G 3/3648 349/68 |
| 2008/0123033 | A1* | 5/2008 | Grip | G02F 1/133555 349/114 |
| 2013/0241816 | A1* | 9/2013 | Tang | G02F 1/167 345/107 |
| 2013/0250224 | A1* | 9/2013 | Huo | G02F 1/134309 349/143 |
| 2014/0022148 | A1* | 1/2014 | Kim | G09G 5/003 345/55 |
| 2017/0004794 | A1* | 1/2017 | Huang | G09G 3/3648 |

FOREIGN PATENT DOCUMENTS

| | | | |
|---|---|---|---|
| CN | 101127200 | A | 2/2008 |
| CN | 101153999 | A | 4/2008 |
| CN | 101196665 | A | 6/2008 |
| CN | 101266375 | A | 9/2008 |
| CN | 101546074 | A | 9/2009 |
| CN | 101944340 | A | 1/2011 |
| CN | 102759817 | A | 10/2012 |
| CN | 102998862 | A | 3/2013 |
| CN | 105047143 | A | 11/2015 |
| JP | 2003-344837 | A | 12/2003 |
| JP | 2004170554 | A | 6/2004 |
| TW | 201001035 | A | 1/2010 |

OTHER PUBLICATIONS

Third Office Action dated Jun. 27, 2017 in corresponding Chinese Patent Application No. 201510562982.8.

International Search Report dated Jun. 27, 2016 issued in corresponding International Application No. PCT/CN2016/077191 along with an English translation of the Written Opinion of the International Search Authority.

* cited by examiner

DISPLAY PANEL INCLUDING REFLECTIVE PIXELS AND SELF-DISPLAY PIXELS AND DRIVING METHOD THEREOF, DISPLAY APPARATUS

CROSS-REFERENCE TO RELATED APPLICATION

This is a National Phase Application filed under 35 U.S.C. 371 as a national stage of PCT/CN2016/077191, filed Mar. 24, 2016, an application claiming the benefit of Chinese Application No. 201510562982.8, filed Sep. 7, 2015, the content of each of which is hereby incorporated by reference in its entirety.

TECHNICAL FIELD

The present invention belongs to the field of display technology, and particularly relates to a display panel, a driving method thereof, and a display apparatus.

BACKGROUND

In an existing transflective display apparatus, each pixel has an area which achieves image display (i.e., self-display, or transmissive display) using transmitted light or by self-illumination, and another area which reflects incident ambient light and achieves image display (i.e., reflective display) using the reflected light. The transflective display apparatus may perform reflective display using ambient light when the ambient light is strong, and perform self-display using transmitted light or self-emitted light when the ambient light is weak, so that the two display modes can complement each other to reduce power consumption.

However, it is found in practical applications that reflective display can meet the demand without self-display when the ambient light is strong, and in this case, self-display may cause a waste of energy and affect the effect of reflective display instead; when the ambient light is weak, brightness, definition, and the like of reflective display are poor, which will affect the effect of self-display. Hence, as to the existing transflective display apparatus, self-display and reflective display may not complement each other, but interfere with each other.

SUMMARY

In view of the problem of mutual interference between two display modes in the existing transflective display apparatus, the present invention provides a display panel, a driving method thereof, and a display apparatus, which can achieve a good display effect in both display modes.

Technical solutions adopted to solve the technical problem of the present invention include a display panel including:

a plurality of reflective pixels, which perform image display using reflected light; and a plurality of self-display pixels, which perform image display using transmitted light or self-emitted light.

In some implementations, the display panel includes a plurality of display units, each of which includes one reflective pixel and one self-display pixel adjacent to the reflective pixel.

In some implementations, the display panel further includes: a plurality of gate lines extending in a row direction and a plurality of data lines extending in a column direction; the display units are arranged in a matrix, and the self-display pixel and the reflective pixel in each display unit are arranged adjacently in the column direction; the self-display pixels and the reflective pixels in the display units located in a same column are arranged alternately, and in any two adjacent columns, the self-display pixels are arranged adjacently in the row direction, and the reflective pixels are arranged adjacently in the row direction.

In some implementations, the reflective pixel and the self-display pixel in each display unit are closely arranged, and a black matrix is provided between any two adjacent columns of pixels.

In some implementations, the gate lines are at least partially located at a rear side of the reflective pixels in a light-outgoing direction of the display panel.

In some implementations, the display panel further includes a plurality of gate lines extending in a row direction and a plurality of data lines extending in a column direction; the display units are arranged in a matrix, and the self-display pixel and the reflective pixel in each display unit are arranged adjacently in the row direction; the self-display pixels and the reflective pixels in the display units located in a same row are arranged alternately, and in any two adjacent rows, the self-display pixels are arranged adjacently in the column direction, and the reflective pixels are arranged adjacently in the column direction.

In some implementations, the data lines are at least partially located at a rear side of the reflective pixels in a light-outgoing direction of the display panel.

In some implementations, the reflective pixels and the self-display pixels in the display units located in a same row are respectively controlled by two different gate lines, and the reflective pixels and the self-display pixels in the display units located in a same column are controlled by a same data line.

In some implementations, the two gate lines for controlling the reflective pixels and the self-display pixels in the display units located in the same row are connected to a same drive port through respective switch units; the switch unit corresponding to the gate line for controlling the reflective pixels is controlled by a first control port, and the switch unit corresponding to the gate line for controlling the self-display pixels is controlled by a second control port.

In some implementations, the reflective pixels and the self-display pixels in the display units located in a same row are controlled by a same gate line, and the reflective pixels and the self-display pixels in the display units located in a same column are respectively controlled by two different data lines.

In some implementations, each display unit comprises a self-display pixel in a central area and a reflective pixel that surrounds the self-display pixel and has a pattern matched with that of the self-display pixel.

In some implementations, the self-display pixel has a shape of rectangle, the reflective pixel has a shape of ring matched with the shape of rectangle, and adjacent reflective pixels are closely adjacent.

In some implementations, the display panel further includes a plurality of gate lines extending in a row direction and a plurality of data lines extending in a column direction; the gate lines and the data lines are at a rear side of the reflective pixels in a light-outgoing direction of the display panel.

In some implementations, the reflective pixels and the self-display pixels in the display units located in a same row are respectively controlled by two gate lines, and the reflective pixels and the self-display pixels in the display units located in a same column are controlled by a same data line.

In some implementations, the reflective pixels and the self-display pixels in the display units located in a same row are controlled by a same gate line, and the reflective pixels and the self-display pixels in the display units located in a same column are respectively controlled by two data lines.

In some implementations, the reflective pixels are normally-black pixels; and/or the self-display pixels are normally-black pixels.

In some implementations, the reflective pixels are electronic ink pixels, electrochromic pixels, or liquid crystal pixels; and/or the self-display pixels are liquid crystal pixels or electroluminescent pixels.

The technical solutions adopted to solve the technical problem of the present invention include a display apparatus including the above-described display panel, and the display apparatus is a smart watch, a mobile phone, or a tablet computer.

The technical solutions adopted to solve the technical problem of the present invention include a driving method of the above-described display panel, including steps of:

controlling the reflective pixels such that areas of the reflective pixels serve as a display region for displaying an image, and at the same time, controlling the self-display pixels such that areas of the self-display pixels serve as a black matrix for displaying black, when an intensity of ambient light is larger than or equal to a preset threshold; and controlling the reflective pixels such that the areas of the reflective pixels serve as a black matrix for displaying black, and at the same time, controlling the self-display pixels such that the areas of the self-display pixels serve as a display region for displaying an image, when the intensity of ambient light is smaller than the preset threshold.

In some implementations, in a case where the reflective pixels and the self-display pixels in the display units located in a same row are controlled by a same gate line, and the reflective pixels and the self-display pixels in the display units located in a same column are respectively controlled by two different data lines, when the intensity of ambient light is larger than or equal to the preset threshold, signals of data lines are controlled such that the areas of the reflective pixels serve as a display region for displaying an image and the areas of the self-display pixels serve as a black matrix for displaying black; when the intensity of ambient light is smaller than the preset threshold, the signals of data lines are controlled such that the areas of the reflective pixels serve as a black matrix and the areas of the self-display pixels serve as a display region for displaying an image.

In some implementations, in a case where the reflective pixels and the self-display pixels in the display units located in a same row are respectively controlled by two different gate lines, and the reflective pixels and the self-display pixels in the display units located in a same column are controlled by a same data line, when the intensity of ambient light is larger than or equal to the preset threshold, gate lines are controlled such that the areas of the reflective pixels serve as a display region for displaying an image and the areas of the self-display pixels serve as a black matrix for displaying black; when the intensity of ambient light is smaller than the preset threshold, the gate lines are controlled such that the areas of the reflective pixels serve as a black matrix and the areas of the self-display pixels serve as a display region for displaying an image.

In some implementations, when the self-display pixels or the reflective pixels are normally-black pixels and need to serve as a black matrix to display black, no signal is inputted into the data lines or the gate lines connected to the self-display pixels or the reflective pixels, so that the self-display pixels or the reflective pixels serve as a black matrix to display black.

In some implementations, when the reflective pixels are electrochromic pixels, and the reflective pixels need to serve as a black matrix to display black, no signal is inputted to the reflective pixels after the reflective pixels are restored to their initial black state.

In the display panel of the present invention, the reflective pixels and the self-display pixels, which are operated independently from each other, are included. Therefore, only the reflective pixels may perform image display, and the self-display pixels may be black and function as a black matrix, when ambient light is strong; only the self-display pixels may perform image display, and the reflective pixels may be black and function as a black matrix, when ambient light is weak. In this way, the two types of pixels in the display panel are used to perform image display under different conditions, respectively, and thus, mutual interference between self-display and reflective display will not occur, and display effect will be good.

Figure 1:
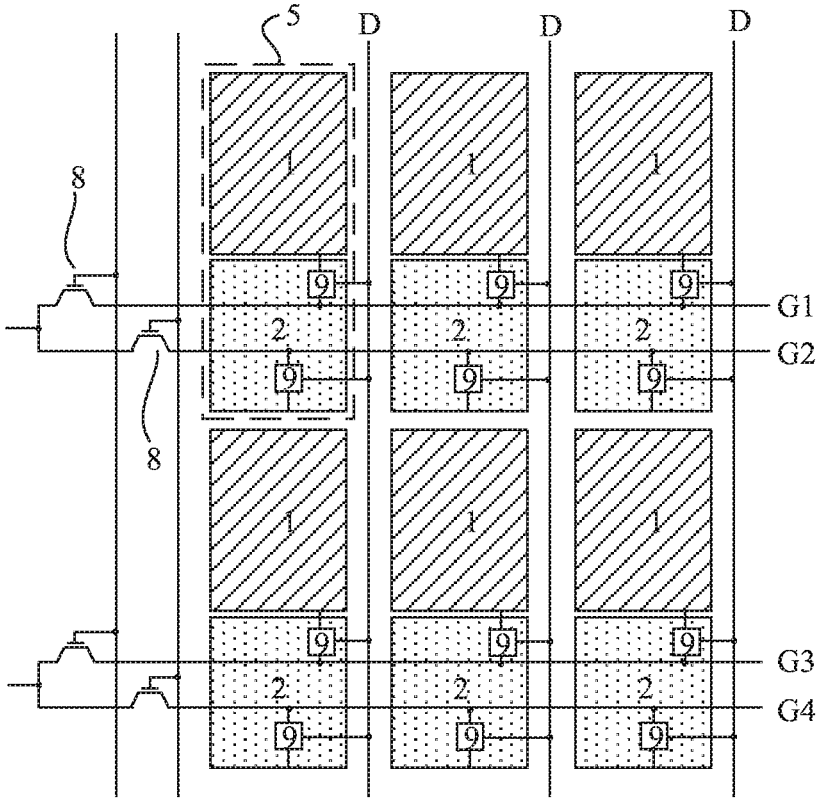
FIG. 1 is a schematic structural diagram of a display panel having a "dual gate line" structure according to an embodiment of the present invention.

Reference Numerals: 1, self-display pixel; 2, reflective pixel; 5, display unit; 8, switch unit; 9, pixel circuit; G, gate line; D, data line.

DETAILED DESCRIPTION

To make those skilled in the art better understand the technical solutions of the present invention, the present invention will be further described in detail below in conjunction with the accompanying drawings and specific implementations.

Embodiments of the present invention provide a display panel, comprising:

a plurality of reflective pixels, which perform image display using reflected light; and a plurality of self-display pixels, which perform image display using transmitted light or by self-illumination.

In the display panel of the embodiment, the reflective pixels and the self-display pixels, which are operated independently from each other, are included. Therefore, only the reflective pixels may perform image display, and the self-display pixels may be black and function as a black matrix, when ambient light is strong; only the self-display pixels may perform image display, and the reflective pixels may be black and function as a black matrix, when ambient light is weak. In this way, the two types of pixels in the display panel are used to perform image display under different conditions, respectively, and thus, mutual interference between self-display and reflective display will not occur, and display effect will be good.

Figure 2:
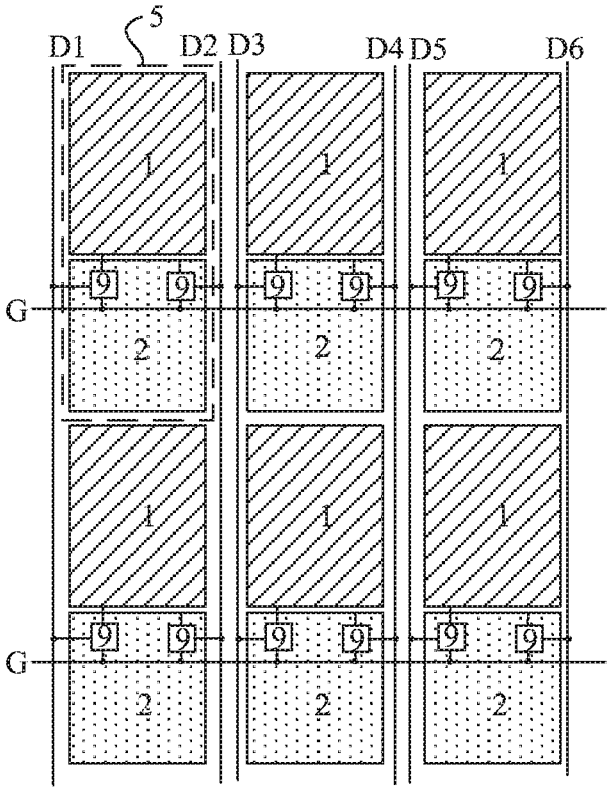
FIG. 2 is a schematic structural diagram of a display panel having a "dual data line" structure according to an embodiment of the present invention.

FIGS. 1 and 2 are schematic structural diagrams of a display panel according to embodiments of the present invention. As shown in FIGS. 1 and 2, the embodiments provide a display panel, which includes a plurality of display units 5. Each display unit 5 includes one reflective pixel 2 and one self-display pixel 1 adjacent to the reflective pixel 2. Each reflective pixel 2 performs image display using reflected light, and each self-display pixel 1 performs image display using transmitted light or self-emitted light.

In the embodiments, the self-display pixels 1 and the reflective pixels 2 in the display panel are provided in pairs (in the form of display units 5), and each display unit 5 includes one self-display pixel 1 and one reflective pixel 2 provided together, which jointly serve as one "dot" on the display panel that can independently perform image display. Furthermore, according to different brightnesses of ambient light, one of the self-display pixel 1 and the reflective pixel 2 included in each display unit 5 is used to display required content, and the other one thereof displays black and functions as a black matrix. Thus, the number of the self-display pixels 1 is the same as that of the reflective pixels 2 in the display panel, and the self-display pixels 1 and the reflective pixels 2 are evenly distributed, so that the two types of pixels have a same resolution during display and both can achieve a good display effect.

Preferably, as shown in FIG. 2, the display panel in the embodiment further includes a plurality of gate lines G extending in a row direction and a plurality of data lines D extending in a column direction; the display units 5 are arranged in a matrix, and the self-display pixel 1 and the reflective pixel 2 in each display unit 5 are arranged adjacently in the column direction; the self-display pixels 1 and the reflective pixels 2 in a same column are arranged alternately; in any two adjacent columns, the self-display pixels 1 are arranged adjacently in the row direction, and the reflective pixels 2 are arranged adjacently in the row direction. A black matrix is provided between adjacent columns of display units. Specifically, all non-display areas between adjacent columns of display units are provided with the black matrix, so that light leakage is avoided and metal lines (such as data lines) are shielded to be prevented from reflecting light.

It should be understood that row and column directions in the display panel merely refer to two relative directions perpendicular to each other. In the embodiments, a direction in which the gate line G extends is the row direction and a direction in which the data line D extends is the column direction, so specific row and column directions are irrelevant to the shape, placement, and the like of the display panel itself.

As shown in FIGS. 1 and 2, the plurality of display units 5 are arranged in row and column directions to form a matrix, two pixels in each display unit 5 are arranged adjacently in the column direction, and relative positional relation of the two pixels in each display unit 5 is the same. Thus, the self-display pixels 1 and the reflective pixels 2 in a same column must be arranged alternately, and the type of the pixels in a same row must be the same.

In some implementations, the gate lines G are at least partially located at a rear side of the reflective pixels 2 in a light-outgoing direction of the display panel. That is to say, the gate lines G are at least partially covered by the reflective pixels 2, when viewed from a light-outgoing surface of the display panel.

In order to reflect incident ambient light, the bottom of each reflective pixel 2 must be provided with a reflective layer, which may be an independently-provided layer, or may also serve as an electrode layer at the same time. The gate lines G provided at the rear side of the reflective layer in the light-outgoing direction of the display panel will not affect display, because in a case where the self-display pixels perform image display, the reflective pixels functioning as a black matrix can shield the gate lines G, and in a case where the reflective pixels perform image display, ambient light is reflected by the reflective layer after being incident on the reflective layer and thus the gate lines provided at the rear side of the reflective layer will not affect display either. As shown in FIGS. 1 and 2, when the display panel is configured in the manner as described above, the reflective pixels 2 are arranged in the row direction, and the gate lines G also extend in the row direction, so the gate lines G may be partially located at the rear side of the reflective pixels 2 (i.e., the reflective layers thereof). In this way, there is no need to arrange the gate lines G in gaps between adjacent rows of pixels, and thus, the gaps are allowed to be narrow enough and there is no need to provide a black matrix, which facilitate improvement in aperture ratio.

It should be noted that, the gate lines G are "partially" located on the rear side of the reflective pixels 2 in the light-outgoing direction of the display panel because a part of the gate lines G, which is located in inevitable gaps between adjacent columns of pixels, is not on the rear side of the reflective pixels 2 in the light-outgoing direction of the display panel.

In addition, the display panel may further include pixel circuits 9 (each including a thin film transistor, a capacitor, etc.) for driving the pixels (including the self-display pixels 1 and the reflective pixels 2) to display an image, and the pixel circuits 9 are preferably provided at the rear side of the reflective pixels 2 in the light-outgoing direction of the display panel.

It should be noted that, in order to clearly illustrate positional relations of the gate lines G, the data lines D, the pixel circuits 9 with respect to the pixels, the figures (FIGS. 1 to 4) are presented in schematic perspective views, and therefore, the positional relations shown in the figures are not intended to limit relative positions of laminated structures. For example, in FIG. 1, the gate lines G are shown to be on the reflective pixels 2, but it should be understood that a part of the gate lines G overlapping with the reflective pixels 2 is actually shielded by the reflective pixels 2.

Preferably, as a pixel control method of the display panel of the embodiment, the reflective pixels 2 and the self-display pixels 1 in the display units 5 located in a same row are controlled by two gate lines G, respectively, and the reflective pixels 2 and the self-display pixels 1 in the display units 5 located in a same column are controlled by a same data line D.

The pixel circuit 9 corresponding to each pixel (reflective pixel 2 or self-display pixel 1) is connected to one gate line G and one data line D, so as to be controlled by the gate line G and the data line D.

In other words, in the display panel of the embodiment, as shown in FIG. 1, the reflective pixels 2 in the display units 5 located in a same row are controlled by one gate line G, the self-display pixels 1 therein are controlled by another gate line G, and the reflective pixels 2 and the self-display pixels 1 in the display units 5 located in a same column are controlled by a same data line D. That is, each display unit 5 corresponds to two gate lines G and one data line D, which is referred to as a "dual gate line" form.

According to the above control method, the pixels connected to each gate line G are of a same type, the pixels connected to each data line D are two types of pixels arranged alternately, and signals in the data lines D approximate each other and thus are easy to control. Hence, the above control structure is particularly suitable for a case where a driving voltage range required for the reflective pixels 2 approximates that required for the self-display pixels 1 (for example, the reflective pixels 2 and the self-display pixels 1 are all liquid crystal pixels), because driving voltages for the two types of pixels in a same column are provided by a same data line D, that is, by a port of one drive chip. If the driving voltage ranges required for the two types of pixels approximate each other, the range of voltages that needs to be provided by the drive chip is relatively small, and can be easily achieved.

Further preferably, two gate lines G for controlling the reflective pixels 2 and the self-display pixels 1 in the display units 5 located in a same row are connected to a same drive port through respective switch units 8; the switch unit 8 corresponding to the gate line G for controlling the reflective pixels 2 is controlled by a first control port, and the switch unit 8 corresponding to the gate line G for controlling the self-display pixels 1 is controlled by a second control port.

In other words, as shown in FIG. 1, two gate lines G for controlling the reflective pixels 2 and the self-display pixels 1 in the display units 5 located in a same row are connected to a same drive port (e.g., an output terminal of a GOA circuit) through respective switch units 8 (e.g., thin film transistors), respectively, wherein the switch unit 8 corresponding to the gate line G for controlling the reflective pixels 2 and the switch unit 8 corresponding to the gate line G for controlling the self-display pixels 1 are controlled by different control ports, respectively. In this way, when one drive port provides a signal for turning on the gate line G, the two gate lines G connected to the drive port can be turned on in turn if the two control ports take turns to output a signal for turning on the respective switch units 8. Thus, one turn-on signal provided by one drive port are divided into two parts respectively used for driving two gate lines G, which can be easily implemented.

Preferably, as another pixel control method of the display panel of the embodiment, the reflective pixels 2 and the self-display pixels 1 in the display units 5 located in a same row are controlled by a same gate line G, and the reflective pixels 2 and the self-display pixels 1 in the display units 5 located in a same column are controlled by two data lines D, respectively.

In other words, as shown in FIG. 2, the pixel circuits 9 of the reflective pixels 2 and the self-display pixels 1 in the display units 5 located in a same row are connected to a same gate line G, and the pixel circuits 9 of the reflective pixels 2 and the self-display pixels 1 in the display units 5 located in a same column are respectively controlled by two data lines D. Specifically, the reflective pixels 2 in the display units 5 located in a same column are controlled by one data line D, and the self-display pixels 1 therein are controlled by another date line D. That is, each display unit 5 corresponds to one gate line G and two data lines D, which is referred to as a "dual data line" form.

According to the above control method, the pixels connected to each data line D are of a same type. The above control structure is particularly suitable for a case where difference between a driving voltage range required for the reflective pixels 2 and a driving voltage range required for the self-display pixels 1 is large (for example, the two types of pixels are in different forms), because the data lines D for controlling different pixels may be respectively connected to two different chips for providing different ranges of driving voltages in this case.

It should be understood that, the above-described pixel control methods are not limited by the arrangement of the two types of pixels in each display unit 5. In a case where the arrangement of the reflective pixel 2 and the self-display pixel 1 in each display unit 5 is different from that described above, the above "dual gate line" or "dual data line" control method can still be adopted, as long as the two types of pixels in the display unit 5 can still be connected to corresponding pixel circuits 9 through wires after the relative relation the two types of pixels is changed.

Preferably, the reflective pixels 2 are normally-black pixels; and/or the self-display pixels 1 are normally-black pixels.

The reflective pixels 2 and the self-display pixels 1 may be formed as normally-black pixels using particular known structure and known material. Here, the "normally-black pixel" refers to a pixel which displays pure black when being applied with a lowest driving voltage (such as 0V) or no voltage. Apparently, in the display panel of the embodiment, when pixels of one type display desired content, pixels of the other type display black, and thus, normally-black pixels are preferably adopted to reduce the power consumption to the greatest extent when the pixel displays black.

In some implementations, the reflective pixels 2 are electronic ink pixels, electrochromic pixels, or liquid crystal pixels; and/or the self-display pixels 1 are liquid crystal pixels or electroluminescent pixels.

In other words, the reflective pixels 2 may be conventional pixels such as electronic ink pixels, electrochromic pixels, liquid crystal pixels or the like, which can perform image display using reflected ambient light, and the self-display pixels 1 may be conventional pixels such as liquid crystal pixels, electroluminescent pixels, or the like, which can perform image display using transmitted light (e.g., in the case of liquid crystal pixels) or self-emitted light (in the case of electroluminescent pixels).

The pixels in the display panel of the embodiment may be in known forms, and thus are not described in detail here.

Figure 3:
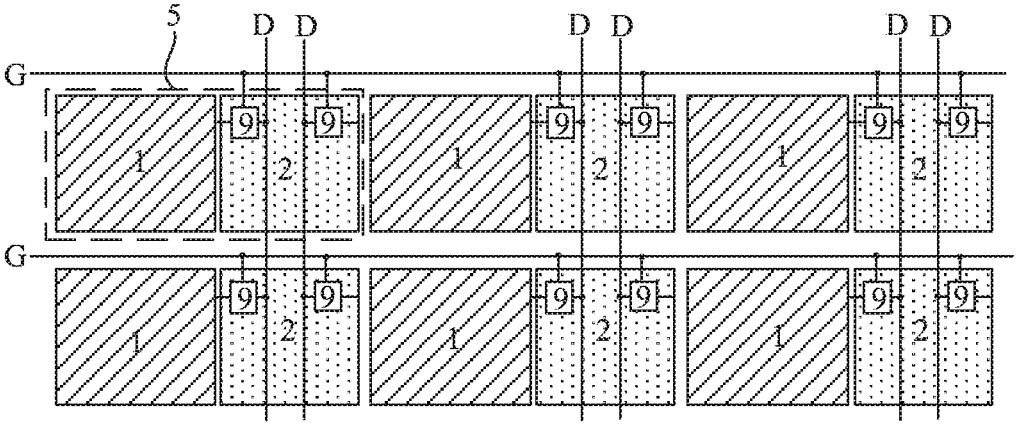
FIG. 3 is a schematic structural diagram of another display panel according to an embodiment of the present invention.

FIG. 3 is a schematic structural diagram of another display panel according to an embodiment of the present invention. As shown in FIG. 3, this embodiment provides a display panel, which has a similar structure to that of the display panel in the above embodiment.

Unlike the display panel in the above embodiment, in the display panel of this embodiment, the self-display pixel 1 and the reflective pixel 2 in each display unit 5 are arranged adjacently in the row direction; the self-display pixels 1 and the reflective pixels 2 in the display units 5 in a same row are arranged alternately; in any two adjacent rows, the self-display pixels 1 are arranged adjacently in the column direction, and the reflective pixels 2 are arranged adjacently in the column direction. A black matrix is provided between two adjacent rows of display units. Specifically, all non-display areas between adjacent rows of display units are provided with the black matrix, so that light leakage is avoided and metal lines can be shielded to avoid light reflection.

In other words, as shown in FIG. 3, the two types of pixels in each display unit 5 of the display panel of this embodiment are arranged in a different manner from that in the above embodiment, and are arranged in the row direction; in addition, relative positional relation of the two types of pixels in each display unit 5 is the same, so the two types of pixels must be arranged alternately in the row direction, and in the column direction, the pixels in a same column are of a same type.

Further preferably, the data lines D are at least partially located on the rear side of the reflective pixels 2 in the light-outgoing direction of the display panel.

Apparently, according to the above arrangement, the reflective pixels 2 are arranged in the column direction, and the data lines D also extend in the column direction, and thus, in this case, part of the data lines D may be provided at the rear side of the reflective pixels 2 in the light outgoing direction of the display panel.

Needless to say, as described above, the pixels in the embodiment may be controlled in the above-described "dual gate line" or "dual data line" form. As an example, FIG. 3 illustrates a structure in which pixels are controlled in the "dual data line" form, which is not described in detail here.

Figure 4:
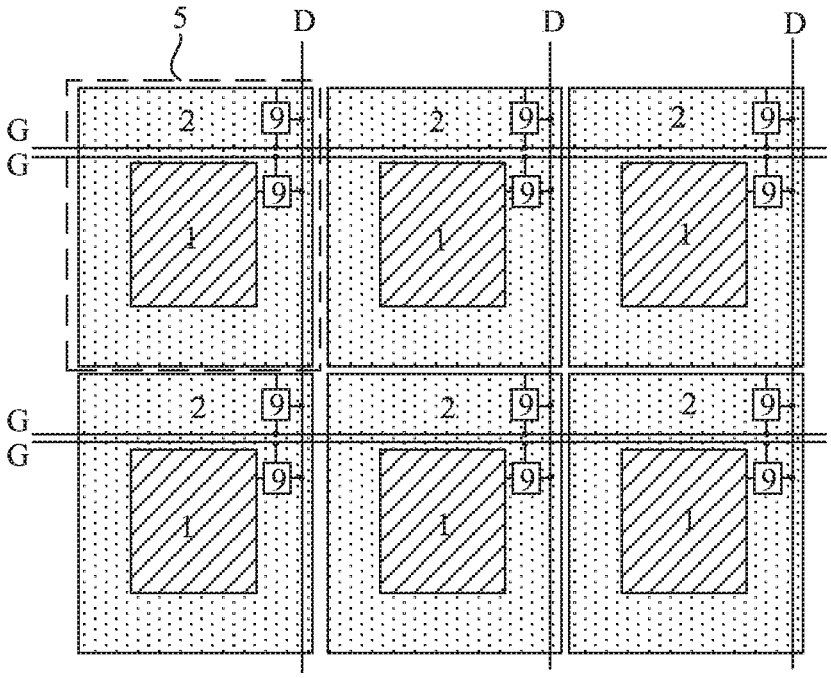
FIG. 4 is a schematic structural diagram of another display panel according to an embodiment of the present invention.

FIG. 4 is a schematic structural diagram of another display panel according to an embodiment of the present invention. As shown in FIG. 4, the embodiment provides a display panel, which has a similar structure to that of the display panel in the above embodiments.

Unlike the display panel in the above embodiment, in the display panel of the embodiment, each display unit 5 includes a self-display pixel 1 in a central area and a reflective pixel 2 that surrounds the self-display pixel 1 and has a pattern matched with that of the self-display pixel 1.

In other words, as shown in FIG. 4, each display unit 5 includes the self-display pixel 1 in the central area and the reflective pixel 2 closely surrounding the self-display pixel 1. Here, "being matched with" means the reflective pixel 2 closely surrounds the self-display pixel 1 and occupies other area of the display unit 5 than the central area, that is, there is no specially-set gap between the reflective pixel 2 and the self-display pixel 1. Needless to say, since the reflective pixel 2 and the self-display pixel 1 are two independent pixels, there is an inevitable gap between the two due to factors such as process accuracy, but the gap is not expected in design.

In some implementations, the self-display pixel 1 has a shape of rectangle, the reflective pixel 2 has a shape of ring matched with the shape of rectangle, and adjacent reflective pixels 2 (or, adjacent display units 5) are closely adjacent.

In other words, as shown in FIG. 4, it is preferable that the self-display pixel 1 has a shape of rectangle, the reflective pixel 2 has a shape of ring (or, a hollow rectangle) surrounding the shape of rectangle, and, between adjacent reflective pixels 2, there is only an inevitable gap for separating pixels and no specially-set gap.

As described above, display is not impacted when structures such as the gate lines G, the data lines D or the like are provided at the rear side of the reflective pixels 2 in the light-outgoing direction of the display panel. According to the structure shown in FIG. 4, the reflective pixels 2 are substantially continuously distributed in both row and column directions. Hence, the gate lines G, the data lines D, the pixel circuits 9 and the like may be provided on the rear side of the reflective pixels 2 in the light-outgoing direction of the display panel, and there is no need to have a gap between pixels to accommodate wires (needless to say, there may be an inevitable gap). As a result, the gap between pixels may be rather narrow, and the black matrix may not be provided, thereby simplifying the manufacturing process of the display panel (omitting the step of forming the black matrix), reducing costs, and increasing aperture ratio.

Needless to say, in order to avoid light leakage in the inevitable gap between pixels, some of the wires (or part of the wires) may be provided in the gap and play a simple light blocking effect.

Needless to say, as described above, the pixels in the embodiment may be controlled in the above-described "dual gate line" or "dual data line" form. As an example, FIG. 4 illustrates a structure in which pixels are controlled in the "dual gate line" form, which is not described in detail here.

Embodiments of the present invention further provide a display apparatus, which includes the display panel described in the above embodiments.

The display apparatus in the embodiment includes the display panel described in the above embodiments, and thus can achieve a good display effect in both cases of strong ambient light and weak ambient light.

Specifically, the display apparatus of the embodiment may be a wearable device such as a smart watch, an intelligent eyeglass or the like, a smart home, a mobile phone, a tablet computer, a monitor, etc. In particular, since the smart watch has a low demand for resolution, display accuracy and the like, has a limited battery capacity, and has a high demand for energy conservation, it can achieve a better effect with the technical solutions of the present invention.

Embodiments of the present invention further provide a driving method of the above display panel, comprising steps of:

controlling the reflective pixels such that areas of the reflective pixels serve as a display region for displaying an image, and at the same time, controlling the self-display pixels such that areas of the self-display pixels serve as a black matrix for displaying black, when the intensity of ambient light is larger than or equal to a preset threshold; and controlling the self-display pixels such that the areas of the self-display pixels serve as a display region for displaying an image, and at the same time, controlling the reflective pixels such that the areas of the reflective pixels serve as a black matrix for displaying black, when the intensity of ambient light is smaller than the preset threshold.

The driving method provided in the embodiment is described in detail now by taking the display panel shown in FIGS. 1 and 2 as an example.

As shown in FIG. 1, the reflective pixels 2 and the self-display pixels 1 in the display units 5 located in a same row are respectively controlled by two different gate lines G, and the reflective pixels 2 and the self-display pixels 1 in the display units 5 located in a same column are controlled by a same data line D.

When the intensity of ambient light is no larger than a preset threshold, the self-display pixels are driven in a scan manner through gate lines G1, G3, G5, . . . , to display an image, and the reflective pixels are driven through gate lines G2, G4, G6, . . . , to display black and serve as a black matrix. In this case, the reflective pixels are preferably normally-black pixels, which can display pure black without being applied with a driving signal. If the reflective pixels are electrochromic pixels or the like, the driving signal applied thereto may be removed after the reflective pixels are restored to their initial black state, so that the reflective pixels function as a black matrix. When the intensity of ambient light is larger than the preset threshold, the reflective pixels are driven in a scan manner through gate lines G2, G4, G6, . . . , to display an image, and the self-display pixels are driven through gate lines G1, G3, G5, . . . , to display black and serve as a black matrix.

As shown in FIG. 2, the reflective pixels 2 and the self-display pixels 1 in the display units 5 located in a same row are controlled by a same gate line G, and the reflective pixels 2 and the self-display pixels 1 in the display units 5 located in a same column are respectively controlled by two different data lines D.

When the intensity of ambient light is no larger than a preset threshold, the self-display pixels are driven through data lines D1, D3, D5, . . . , to display an image, and the reflective pixels are driven through data lines D2, D4, D6, . . . , to display black and serve as a black matrix. In this case, if the reflective pixels are electrochromic pixels, electronic ink pixels or the like, the driving signal applied thereto may be removed after the reflective pixels are driven to be black, and the reflective pixels can maintain black afterwards. When the intensity of ambient light is larger than the preset threshold, the reflective pixels are driven through data lines D2, D4, D6, . . . , to display an image, and the self-display pixels are driven through data lines D1, D3, D5, . . . , to display black and serve as a black matrix. In this case, if the self-display pixels are normally-black pixels, the self-display pixels can display black when the data lines D1, D3, D5, . . . are applied with no driving voltage.

According to the driving method of the above display panel provided in the embodiment, the reflective pixels display desired content and the self-display pixels display black to serve as a black matrix when ambient light is strong; the self-display pixels display desired content and the reflective pixels display black to serve as a black matrix when ambient light is weak. Thus, two types of pixels are used for image display under different conditions, respectively, so mutual interference between self-display and reflective display will not occur, and the display effect will be good.

In addition, a photosensitive unit may be provided in the display panel to detect the intensity of ambient light, or a person may feel the intensity of ambient light and determine the display mode.

It can be understood that, the above implementations are merely exemplary implementations used for explaining the principle of the present invention, but the present invention is not limited thereto. For those skilled in the art, various modifications and improvements may be made without departing from the spirit and essence of the present invention, and these modifications and improvements are also deemed as falling within the protection scope of the present invention.

The invention claimed is:

1. A display panel, comprising a plurality of display units arranged in a matrix, each of which comprises one reflective pixel that performs image display using reflected light and one self-display pixel that is adjacent to the reflective pixel and performs image display using transmitted light or self-emitted light;

wherein the display panel further comprises a plurality of gate lines extending in a row direction and a plurality of data lines extending in a column direction, in a same row of display pixels, the reflective pixels are controlled by one gate line, and the self-display pixels are controlled by another different gate line; and in a same column of display pixels, the reflective pixels and the self-display pixels are controlled by a same data line.

2. The display panel according to claim 1, wherein the self-display pixel and the reflective pixel in each display unit are arranged adjacently in the column direction; and the self-display pixels and the reflective pixels in the display units located in the same column are arranged alternately, and in any two adjacent columns, the self-display pixels are arranged adjacently in the row direction, and the reflective pixels are arranged adjacently in the row direction.

3. The display panel according to claim 2, wherein, the gate lines are at least partially located on a rear side of the reflective pixels in a light-outgoing direction of the display panel.

4. The display panel according to claim 1, wherein, two gate lines for controlling the reflective pixels and the self-display pixels in the display units located in the same row are connected to a same drive port through two switch units corresponding to the two gate lines; and the switch unit corresponding to the gate line for controlling the reflective pixels is controlled by a first control port, and the switch unit corresponding to the gate line for controlling the self-display pixels is controlled by a second control port.

5. The display panel according to claim 1, wherein each display unit comprises a self-display pixel in a central area, and a reflective pixel that surrounds the self-display pixel and has a pattern matched with that of the self-display pixel.

6. The display panel according to claim 5, wherein, the self-display pixel has a shape of rectangle, the reflective pixel has a shape of ring matched with the shape of rectangle, and adjacent reflective pixels are closely adjacent.

7. The display panel according to claim 5, wherein the gate lines and the data lines are on a rear side of the reflective pixels in a light-outgoing direction of the display panel.

8. The display panel according to claim 1, wherein, the reflective pixels are normally-black pixels; and/or the self-display pixels are normally-black pixels.

9. The display panel according to claim 1, wherein, the reflective pixels are electronic ink pixels, electrochromic pixels, or liquid crystal pixels; and/or the self-display pixels are liquid crystal pixels or electroluminescent pixels.

10. A display apparatus, comprising the display panel according to claim 1, wherein the display apparatus is a smart watch, a mobile phone, or a tablet computer.

11. A driving method of a display panel, wherein the display panel comprises a plurality of reflective pixels that perform image display using reflected light and a plurality of self-display pixels that perform image display using transmitted light or self-emitted light, and the driving method of the display panel comprises steps of:

controlling the reflective pixels and the self-display pixels such that areas of the reflective pixels serve as a display region for displaying an image, and areas of the self-display pixels serve as a black matrix for displaying black, when an intensity of ambient light is larger than or equal to a preset threshold; and controlling the reflective pixels and the self-display pixels such that the areas of the reflective pixels serve as a black matrix for displaying black, and the areas of the self-display pixels serve as a display region for displaying an image, when the intensity of ambient light is smaller than the preset threshold, wherein the display panel comprises a plurality of display units, each of which comprises one reflective pixel and one self-display pixel adjacent to the reflective pixel, the display units are arranged in a matrix, and the self-display pixel and the reflective pixel in each display unit are arranged adjacently in the column direction, the display panel further comprises: a plurality of gate lines extending in a row direction and a plurality of data lines extending in a column direction;

the self-display pixels and the reflective pixels in the display units located in a same column are arranged alternately, and in any two adjacent columns, the self-display pixels are arranged adjacently in the row direction, and the reflective pixels are arranged adjacently in the row direction the reflective pixels and the self-display pixels in the display units located in a same row are controlled by a same gate line, and the reflective pixels and the self-display pixels in the display units located in a same column are respectively controlled by two different data lines, and wherein, when the intensity of ambient light is larger than or equal to the preset threshold, signals of the data lines are controlled such that the areas of the reflective pixels serve as a display region for displaying an image and the areas of the self-display pixels serve as a black matrix for displaying black; when the intensity of ambient light is smaller than the preset threshold, the signals of the data lines are controlled such that the areas of the reflective pixels serve as a black matrix and the areas of the self-display pixels serve as a display region for displaying an image.

12. A driving method of a display panel, wherein the display panel comprises a plurality of reflective pixels that perform image display using reflected light and a plurality of self-display pixels that perform image display using transmitted light or self-emitted light, and the driving method of the display panel comprises steps of:

controlling the reflective pixels and the self-display pixels such that areas of the reflective pixels serve as a display region for displaying an image, and areas of the self-display pixels serve as a black matrix for displaying black, when an intensity of ambient light is larger than or equal to a preset threshold; and controlling the reflective pixels and the self-display pixels such that the areas of the reflective pixels serve as a black matrix for displaying black, and the areas of the self-display pixels serve as a display region for displaying an image, when the intensity of ambient light is smaller than the preset threshold, wherein the display panel comprises a plurality of display units, each of which comprises one reflective pixel and one self-display pixel adjacent to the reflective pixel, the display units are arranged in a matrix, and the self-display pixel and the reflective pixel in each display unit are arranged adjacently in the column direction, the display panel further comprises: a plurality of gate lines extending in a row direction and a plurality of data lines extending in a column direction;

the self-display pixels and the reflective pixels in the display units located in a same column are arranged alternately, and in any two adjacent columns, the self-display pixels are arranged adjacently in the row direction, and the reflective pixels are arranged adjacently in the row direction the reflective pixels and the self-display pixels in the display units located in a same row are respectively controlled by two different gate lines, and the reflective pixels and the self-display pixels in the display units located in a same column are controlled by a same data line, and wherein, when the intensity of ambient light is larger than or equal to the preset threshold, gate lines are controlled such that the areas of the reflective pixels serve as a display region for displaying an image and the areas of the self-display pixels serve as a black matrix for displaying black; when the intensity of ambient light is smaller than the preset threshold, the gate lines are controlled such that the areas of the reflective pixels serve as a black matrix and the areas of the self-display pixels serve as a display region for displaying an image.

13. A driving method of a display panel, wherein the display panel comprises a plurality of reflective pixels that perform image display using reflected light and a plurality of self-display pixels that perform image display using transmitted light or self-emitted light, and the driving method of the display panel comprises steps of:

controlling the reflective pixels and the self-display pixels such that areas of the reflective pixels serve as a display region for displaying an image, and areas of the self-display pixels serve as a black matrix for displaying black, when an intensity of ambient light is larger than or equal to a preset threshold; and controlling the reflective pixels and the self-display pixels such that the areas of the reflective pixels serve as a black matrix for displaying black, and the areas of the self-display pixels serve as a display region for displaying an image, when the intensity of ambient light is smaller than the preset threshold, wherein when the self-display pixels or the reflective pixels are normally-black pixels and need to serve as a black matrix to display black, no signal is inputted into data lines or gate lines connected to the self-display pixels or the reflective pixels, so that the self-display pixels or the reflective pixels serve as a black matrix to display black.

14. A driving method of a display panel, wherein the display panel comprises a plurality of reflective pixels that perform image display using reflected light and a plurality of self-display pixels that perform image display using transmitted light or self-emitted light, and the driving method of the display panel comprises steps of:

controlling the reflective pixels and the self-display pixels such that areas of the reflective pixels serve as a display region for displaying an image, and areas of the self-display pixels serve as a black matrix for displaying black, when an intensity of ambient light is larger than or equal to a preset threshold; and controlling the reflective pixels and the self-display pixels such that the areas of the reflective pixels serve as a black matrix for displaying black, and the areas of the self-display pixels serve as a display region for displaying an image, when the intensity of ambient light is smaller than the preset threshold, wherein when the reflective pixels are electrochromic pixels, and the reflective pixels need to serve as a black matrix to display black, no signal is inputted to the reflective pixels after the reflective pixels are restored to their initial black state.

* * * * *